United States Patent [19]

Ryder

[11] Patent Number: 4,756,438

[45] Date of Patent: Jul. 12, 1988

[54] CONTAINER WITH THREADED CLOSURE AND TAMPER-EVIDENT FEATURE

[75] Inventor: Geoffrey A. Ryder, Welwyn Garden City, England

[73] Assignee: W. R. Grace & Co., Lexington, Mass.

[21] Appl. No.: 63,206

[22] Filed: Jun. 17, 1987

[30] Foreign Application Priority Data

Jun. 17, 1986 [GB] United Kingdom ..... 8614734

[51] Int. Cl.[4] ..... B65D 41/34

[52] U.S. Cl. ..... 215/252

[58] Field of Search ..... 215/252

[56] References Cited

U.S. PATENT DOCUMENTS 3,484,012 12/1969 White et al. ..... 215/252
4,156,490 5/1979 Peraboni ..... 215/252
4,448,318 5/1984 Lowe ..... 215/252
4,530,438 7/1985 McDevitt ..... 215/252
4,699,285 10/1987 Perne et al. ..... 215/252

FOREIGN PATENT DOCUMENTS 2352719 12/1977 France .

*Primary Examiner*—Donald F. Norton
*Attorney, Agent, or Firm*—John Dana Hubbard; William L. Baker

[57] ABSTRACT

The present invention relates to a tamper-evident container having a threaded neck to receive a threaded closure having a tamper evident feature. The container has a tamper-evident feature bead for retaining the feature on the container. The bead has one or more outwardly and downwardly shaped bulges which, as the closure is twisted off, apply a localized rupturing force on the tamper-evident feature so as to tear the feature away from the closure.

10 Claims, 3 Drawing Sheets

CONTAINER WITH THREADED CLOSURE AND TAMPER-EVIDENT FEATURE

The present invention relates to a container having a threaded neck to receive a threaded closure, with a tamper-evident feature associated with the closure. In particular the invention can be applied to a threaded jar or bottle, moulded of glass.

Many packaging containers currently available are provided with a so-called "tamper-evident" feature which makes it quite clear to a consumer if someone has already gained access to the contents of the container. For example, bottles are known where there is a separate ring attached to the end of the skirt of the threaded closure to be broken from the rest of the skirt when the closure is unscrewed. The thin uniform character of the aluminium sheeting from which such screw closures are frequently formed renders the provision of a ring attached by narrow bridges which are readily frangible a practical construction.

However, where the screw closure is formed of some other material for example plastic there can be a problem in that the narrow bridges joining the tamper-evident locking ring to the skirt of the closure proper may not all break before the closure comes off the threads of the container neck. Indeed it may even be that when only some of those bridges break the load on the remaining bridges during unscrewing of the closure is relieved causing them to remain intact.

It is an object of the present invention to provide a tamper-evident feature for a threaded closure for use with a container such that the likelihood of the bridges joining the closure to the tamper-evident means being broken during unscrewing of the closure is increased.

In the past it has been possible to provide plastic containers having a ratchet type of external tooth formation which engages with a corresponding ratchet formation internally on the tamper-evident ring so that, when the container closure is screwed on, the teeth of the ratchet slip over one another but when the closure is unscrewed the teeth engage and generate an insurmountable torque holding the tamper-evident ring against removal and therefore compelling all of the bridges to break simultaneously.

However, while such a ratchet formation can be moulded with plastic where the container moulds do not undergo any appreciable wear during their working life, this is not possible with glass where the heated glass causes rapid wear of the moulds. It is a principal aim of the present invention to provide some means of generating a tamper-evident feature which will work with a plastic closure and a container moulded of a hard material such as glass and which will allow a simpler container mould construction than hitherto.

Accordingly, the present invention provides the combination of a tamper-evident threaded closure and a container having a threaded neck, in which the closure includes an integrally formed tamper-evident ring to be separated from the rest of the closure by rupturing of frangible closure portions, the design of the container being such that the closure frangible portions are broken progressively as the closure is twisted off the container.

In order that the present invention may more readily be understood the following description is given, merely by way of example, with reference to the accompanying drawings in which.

Figure 1:
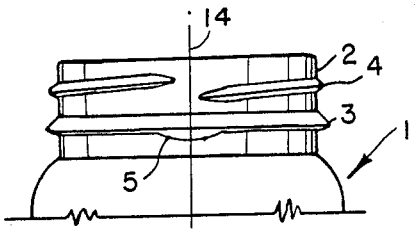
FIG. 1 shows a side elevational view of the threaded neck of a glass jar incorporating the present invention.

In FIG. 1 the container can be seen as a jar 1 having a cylindrical neck 2 with an optionally continuous external bead 3 which serves to retain a tamper-proof means in the form of a ring of a suitable closure. Above the bead 3 is a two-start thread 4 in accordance with British Patent Application No. 8610570.

As shown in FIG. 1, the underside of the bead 3 has a projection 5, in this case in the form of a relatively wide arcuate bulge. The purpose of this will be evident from the later description.

Figure 2:
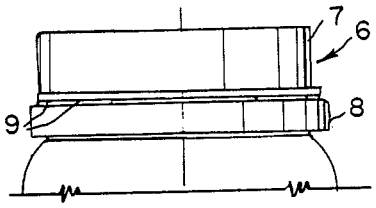
FIG. 2 is a view similar to FIG. 1 showing a closure screwed in place on the jar neck.

FIG. 2 shows the closure 6 as comprising a cap portion 7 and an integrally moulded tamper-evident ring 8 joined to the cap by thin frangible plastic bridges 9 equiangularly spaced around the circumference of the cap.

Figure 3:
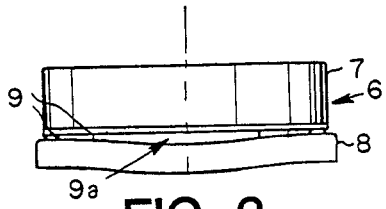
FIG. 3 is a view similar to FIGS. 1 and 2 but showing the closure during the early stages of unscrewing.

FIG. 3 shows the start of separation of the tamper-evident ring 8 from the cap portion 7 and shows one of the frangible bridges **9*a* being broken due to the fact that the cap 7 is rising during unscrewing, but the tamper-evident ring 8 is locally held down by the bulge 5. Clearly this causes the bridge 9*a* to rupture at a different time from the instant of rupture of either of the adjacent bridges 9**.

Figure 4:
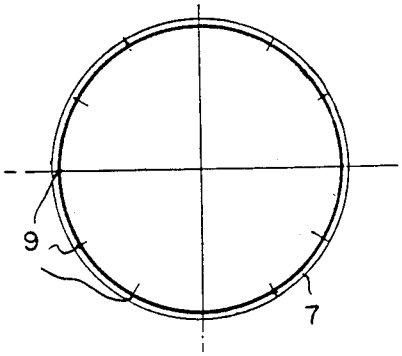
FIG. 4 is a schematic view of the closure, after separation of the tamper-evident ring, and showing the locations of the ruptured bridges.

FIG. 4 is an underneath plan view of the cap portion 7, after separation of the tamper-evident ring 8, and shows the various locations of the broken bridges 9.

Figure 5:
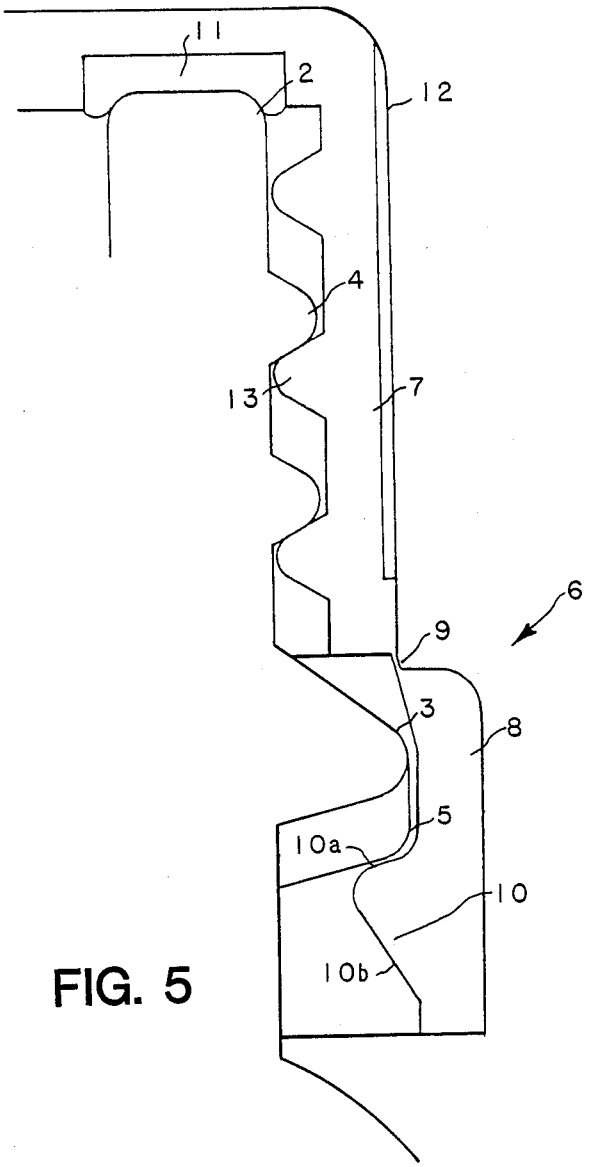
FIG. 5 is a longitudinal sectional view of one side of the threaded neck of the jar shown in FIGS. 1 and 2.

The longitudinal sectional view shown in FIG. 5 illustrates the tamper-evident ring of the closure as having a radially inwardly extending bead 10 with an upper coaxial surface **10*a* which is very shallowly inclined to the horizontal (and exhibits substantially the same inclination to the horizontal as does the underside of the bulge 5 also shown in FIG. 5), and a lower conical surface 10*b* which is much more steeply inclined to the horizontal and therefore readily rides over the bead 3 and the projection 9 as the closure 6** is being screwed onto the jar neck.

FIG. 5 also illustrates an annular liner 11 formed in a suitable groove in the top panel of the cap portion 7 to seal against the end face of the cylindrical jar neck 2.

Additionally, the cap 7 has external knurling at 12 to facilitate unscrewing by the user.

The operation of the above-described closure 6 is as follows:

The closure is moulded with the cap portion and the tamper-evident ring 8 integral by virtue of, in this case twelve, equiangularly spaced bridges 9. Normally the closure will have less than twelve bridges.

As the closure is screwed down by engagement of the closure threads 13 with the jar neck threads 4 the relatively steeply inclined (shallowly conical) ramp surface 10*b* on the underside of the bead 10 of the tamper-evident ring 8 rides over the outwardly projecting tamper-evident bead 3 of the jar neck. The elasticity of the tamper-evident ring 8 is sufficient to allow this movement and to cause the bead 10 to snap back into place underneath the bulge 5 when the cap portion 7 has been screwed fully home.

The jar is now sealed and is ready for display and sale.

Any person buying such a container can readily tell that it has not been opened, simply by examining the combination of the cap portion 7 and the tamper-evident ring 8 to ensure that they are parallel to one another as shown in FIG. 2 and that the bridges 9 are intact.

When the cap portion 7 is unscrewed it begins to rise and immediately the part of the inwardly projecting bead 10 of the tamper-evident ring which is directly below the bulge 5 has its part of the upper surface 10*a* in contact with the bulge 5 exerting a force tending to pull the tamper-evident ring 8 locally away from the cap portion 7.

As soon as one of the frangible bridges 9 comes into this position 9*a* of FIG. 3, as shown in FIG. 5, the separating force at that point will break the bridge 9. After further rotation of the closure assembly 6 (in this case through 30°) the next successive bridge portion 9 comes into register with the bulge 5 and by virtue of the continuing lifting of the cap portion 7 is subjected to even greater separating force which causes it to break. This procedure continues until all of the bridges 9 have been broken.

Although it will be understood that the lifting of the cap portion 7 will eventually reach a situation where the bead 10 of the tamper-evident ring contacts the underside of the tamper-evident bead 3 itself even away from the bulge 5 (with the possible result of rupturing any remaining bridges 9), initially one, two or even more of the bridges 9 are ruptured one at a time.

Yet another possibility is that the number of bulges is related to the number of bridges to be broken, taking into account the amount by which the cap can be unscrewed before the threads of the cap disengage from the threads of the bottle neck. Depending upon the number of bridges, and the amount of rotation of the cap before thread disengagement, it may be necessary for the bulges not to be equiangularly spaced so as to ensure that all bridges are broken before thread disengagement. The arrangement of the bulges may also be such that more than one bridge is broken at the same time provided that this does not detract from the objective of the invention, namely the deliberate breaking of the individual bridges. For example, in the case of a two start thread, the bulges may be so arranged that diametrically opposed bridges are broken simultaneously.

It may for example be advantageous to incorporate the same number of bulges 5 as there are thread starts, with the bulges equiangularly spaced around the jar neck. If desired the number of bulges 5 may exceed the number of thread starts by one. Another possibility is for there to be more bulges than thread starts but with the arrangement such that the number of bulges is an integral multiple of the number of thread starts to preserve symmetry.

The essence of the present invention resides in the fact that whereas in the prior art there has been an equal separating force applied at each of the frangible bridges of a tamper-evident closure, in accordance with the present invention the bridges are deliberately ruptured progressively so that the maximum rupture force is applied and hence all of the bridges will be broken.

Although the invention has been described in terms of a jar having a threaded cap, it can equally be applied to a bottle or to any other container having a threaded rim.

The closure may be formed of any mouldable material, for example polyethylene, polypropylene, ethylene-propylene copolymer, polystyrene, polyacetals or polyesters, or may be formed of mixtures of these materials.

The container may be formed of any mouldable material of a relatively hard configuration, for example glass or a hard plastics material. However, it is particularly advantageous to apply the present invention to a glass contalner because the moulding of the bulge 5 is an easy way to form a means to co-operate with the tamper-evident ring of the closure without suffering the effects of loss of dimensional accuracy as the mould wears in use.

It is particularly convenient for the bulge or bulges 5 to be positioned on the mould parting line 14 of the container neck as shown in FIG. 1. However, other locations are possible and can be moulded without difficulty.

Figure 6:
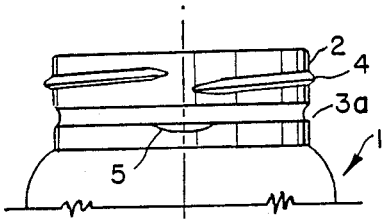
FIG. 6 is a view similar to FIG. 1 but showing a jar having the bridge-rupturing bulges formed alongside a transfer groove.
Figure 7:
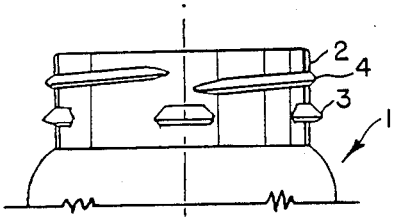
FIG. 7 is a view similar to FIG. 1 but showing a jar having the bridge-rupturing formations in the form of a discontinuous bead on the jar rim exterior.

As indicated above, it is not necessary for the bead 3 to be continuous. In practice this bead serves as a transfer means useful when lifting the moulded container immediately after the moulding operation. As shown in FIG. 6, a transfer means in the form of a groove 3*a* is equally possible. If desired, the means to break the bridge portions may comprise an interrupted bead 3, as in FIG. 7, or a series of lugs on the container neck adjacent a transfer groove (not illustrated).

Further, while this invention has been described with refernce to its preferred embodiments, other embodiments can achieve the same result. Variations and modifications of the present invention will he obvious to those skilled in the art and it is intended to cover in the appended claims all such variations, modifications and equivalents as fall within the true spirit and scope of this invention.

What I claim is:

1. A tamper-evident device comprising a container having a neck which is externally threaded, an outwardly projecting discontinuous tamper-evident ring retaining bead, and a localized downwardly extending projection adjacent the outwardly projecting tamper-evident ring retaining bead; a plastic cap internally threaded and engaging the external threads of container neck, the plastic cap having a tamper-evident ring being releasably secured to the cap by one or more frangible bridges, the tamper-evident ring having an inwardly directed retaining bead cooperating with the outwardly projecting bead of the container neck to retain the tamper-evident ring on the container neck upon removal of the cap.

2. A tamper-evident device of claim 1 wherein the downwardly extending projection is a bulge which applies a localized downward pressure on the tamper-evident ring as the cap is removed so as to rupture the one or more frangible bridges between the ring and the cap.

3. A tamper-evident device of claim 1 wherein the number of downwardly extending projections is an integral multiple of the number of thread starts of the cap threads.

4. A tamper-evident container and cap comprising, in combination:

(a) a container having a neck with one or more external threads, an annular bead formed below the external threads and extending outwardly from the neck and one or more projections extending from the annular bead, (b) a plastic cap having one or more internal threads, and an annular tamper-evident ring attached to a lower portion of the cap by one or more frangible bridges, the tamper-evident ring having an inwardly directed bead cooperating with the annular bead of the container neck for securing the tamper-evident ring to the container neck and wherein the number of projections are equal to the number of frangible bridges.

5. The combination of claim 4 wherein the annular bead of the container neck and the inwardly directed bead of the tamper-evident cap are continuous.

6. The combination of claim 4 wherein the one or more projections are wide accurate bulges extending downwardly from the annular bead of the container neck.

7. The combination of claim 4 wherein the number of projections is an integral number of the number of thread starts on the container neck.

8. A tamper-evident container and cap comprising, in combination:

(a) a container having a neck with one or more external threads, a transfer groove adjacent a lower portion of the threads, and one or more outwardly and downwardly projecting bulges;

(b) a plastic cap having one or more internal threads and an annular tamper-evident ring attached to a lower portion of the cap by one or more frangible bridges, and the tamper-evident ring having an inwardly directed bead cooperating with the bulges for retaining the ring to the container neck.

9. A tamper-evident combination of claim 8 wherein the bulges apply a localized downward rupturing pressure to the tamper-evident ring as the cap is removed.

10. A tamper-evident device comprising a container having a neck which is externally threaded, an outwardly projecting tamper-evident ring retaining bead, and localized downwardly extending projections adjacent the outwardly projecting tamper-evident ring retaining bead, wherein the number of projections is equal to the number of thread starts plus one; a plastic cap internally threaded and engaging the external threads of container neck, the plastic cap having a tamper-evident ring being releasably secured to the cap by one or more frangible bridges, the tamper-evident ring having an inwardly directed retaining bead cooperating with the outwardly projecting bead of the container neck to retain the tamper-evident ring on the container neck upon removal of the cap.

* * * * *